US005209293A

United States Patent [19]

McNaughton et al.

[11] Patent Number: 5,209,293

[45] Date of Patent: May 11, 1993

[54] APPARATUS FOR FLUIDIZING FORMATION FINES ENTRAINED IN FORMATION FLUIDS ENTERING A PRODUCTION WELL PENETRATING AN OIL-BEARING FORMATION

[75] Inventors: Matthew G. McNaughton, Whitecourt; Eugene Ostapovich; Farrokh N. Pebdani, both of Calgary, all of Canada

[73] Assignee: Mobil Oil Corporation, Fairfax, Va.

[21] Appl. No.: 844,080

[22] Filed: Mar. 2, 1992

[51] Int. Cl.[5] ..... E21B 43/00

[52] U.S. Cl. ..... 166/68.5; 166/105; 166/177

[58] Field of Search ..... 166/68.5, 105.1, 177, 166/311

[56] References Cited

U.S. PATENT DOCUMENTS

| | | | |
|---|---|---|---|
| 3,033,615 | 5/1962 | Hahs | 166/68.5 |
| 3,305,825 | 2/1967 | Godbey | 340/18 |
| 3,338,306 | 8/1967 | Cook | 166/40 |
| 3,410,137 | 11/1968 | Slover et al. | 733/155 |
| 3,682,244 | 8/1972 | Bowman et al. | 166/252 |
| 4,421,163 | 12/1983 | Tuttle | 166/59 |
| 4,421,182 | 12/1983 | Moody et al. | 166/105.1 X |
| 4,621,693 | 11/1986 | Caldwell et al. | 166/105.1 X |
| 4,661,052 | 4/1987 | Ruhle | 166/105.1 X |
| 4,711,299 | 12/1987 | Caldwell et al. | 166/105.1 |
| 4,924,940 | 5/1990 | Burroughs et al. | 166/105.1 |
| 4,940,092 | 7/1990 | Ferguson et al. | 16/311 |

*Primary Examiner*—Ramon S. Britts
*Assistant Examiner*—Frank S. Tsay
*Attorney, Agent, or Firm*—Alexander J. McKillop; George W. Hager, Jr.

[57] ABSTRACT

A production well penetrating a subsurface oil-bearing formation utilizes perforations in well casing through which formation fluids enter the well. Production tubing extends from the surface of the earth to a position below such perforations. A pump is positioned at the lower end of the tubing for pumping the formation fluids upwardly through the tubing to the surface of the earth. An agitating unit is positioned below the pump and is rotated in the formation fluid within the well to insure that formation fines entrained in the formation fluids are fluidized for production to the surface of the earth rather than settling out of the formation fluids within the well.

9 Claims, 1 Drawing Sheet

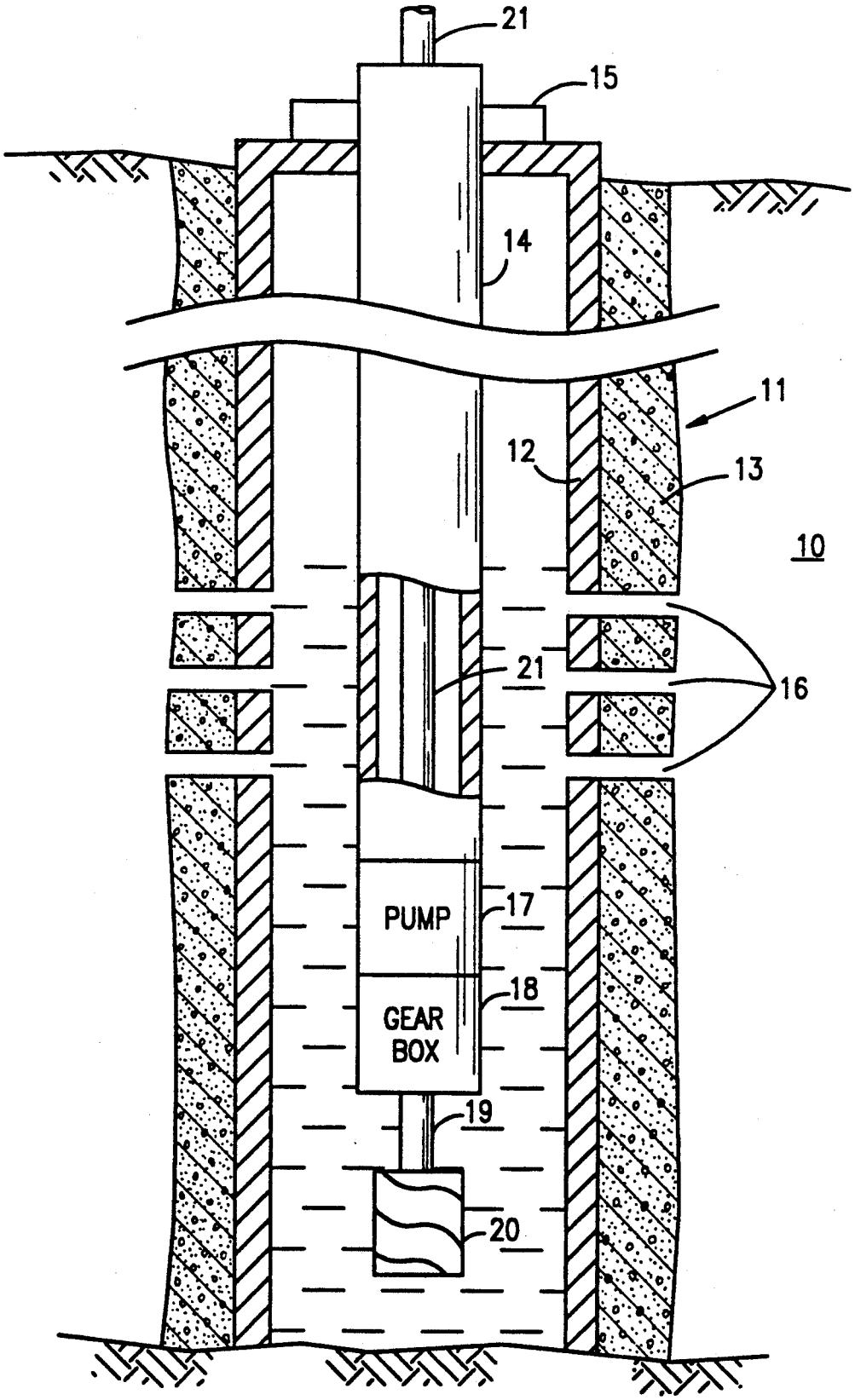
21
15
14
11
12
13
10
21
16
PUMP
17
GEAR
BOX
18
19
20

APPARATUS FOR FLUIDIZING FORMATION FINES ENTRAINED IN FORMATION FLUIDS ENTERING A PRODUCTION WELL PENETRATING AN OIL-BEARING FORMATION

BACKGROUND OF THE INVENTION

Many oil reservoirs, such as heavy oil or tar sand formations, exist which contain vast quantities of oil which cannot be recovered by conventional techniques because the oil is so viscous that it is substantially immobile at reservoir conditions. Therefore, some form of supplemental oil recovery must be used in such formations to decrease the viscosity of the oil sufficiently to allow it to flow through the formation to the production well and then be brought to the surface of the earth. Thermal recovery techniques which decrease the viscosity of such oil and are therefore suitable for stimulating the recovery thereof include steam flooding and in-situ combustion. Because steam is generally the most economical and efficient thermal energy agent, it is clearly the most widely employed.

A thermal recovery process wherein steam flooding is utilized to remove viscous oil from a formation is described in U.S. Pat. No. 4,456,066 to Shu. In another thermal recovery process described in U.S. Pat. No. 4,565,249 to Pebdani et al., a mixture of carbon dioxide and steam is injected into a viscous oil-containing formation. In yet thermal recovery process described in U.S. Pat. No. 4,961,467 to Pebdani, both steam injection and in-situ combustion are utilized in producing a viscous oil-containing formation.

Production wells penetrating subsurface oil-bearing formations utilize perforations in well casing through which formation fluids enter the well. Such oil production wells often penetrate viscous oil-bearing formations. Fines and particles, such as sand, are often entrained in the viscous oil produced from such formations. Because the oils are viscous, conventional gravel pack techniques cannot be used to remove the fines when the viscous oil is produced. Utilization of conventional gravel packs would greatly impede the flow of the viscous oils therethrough and would result in a loss of production. For this reason, these viscous oils are produced to the surface with the fines entrained therein. Once on the surface, the fines are removed from the oil and disposed of.

However, not all the fines entering the production well entrained in the viscous oil will be transported to the surface of the earth. Some of these fines will settle out of the fluid flow up the well and can eventually build up to the point of inhibiting fluid flow and causing shut-down of the well's pump.

It is therefore a specific object of the present invention to provide well apparatus for fluidizing such formation fines within the well so as to prevent their settling and to insure their production through the well pump to the surface of the earth for disposal.

SUMMARY OF THE INVENTION

The present invention is directed to apparatus for fluidizing formation fines, or sand, entrained in formation fluids entering a production well through perforations in well casing penetrating a subsurface oil-bearing formation.

More particularly, production tubing extends from the surface of the earth to a position below the lowermost of the well casing perforations. A downhole pump is positioned at the lower end of the production tubing for pumping the formation fluids upwardly through the tubing to the surface of the earth. An agitating unit is positioned below the pump within the well and is rotated in the formation fluid within the well below the lowermost of the well casing perforations to fluidize formation fines entrained in the formation fluids so that they are produced upwardly through the pump and production tubing to the surface of the earth rather than settling out of the formation fluids within the well.

In a further aspect, a rod extends from the surface of the earth through the tubing to the pump for providing driving motion to the pump. Means is provided for translating this driving motion for the pump to suitable rotational motion for driving the agitating unit. A shaft connects the translating means to the agitating unit, the shaft being rotated in response to the driving motion of the rod.

In a more specific aspect, a reciprocating rod extends from the surface of the earth through the tubing to provide reciprocating driving motion to the pump. A plurality of gears are driven by the reciprocating driving motion of the rod for providing an optimum rate of rotational driving motion to the agitating unit to insure that the formation fines are fluidized for production to the surface of the earth rather than settling out within the well. A shaft connects the rotational motion of such gears to the agitating unit.

In another aspect, a rotating rod extends from the surface of the earth through the tubing to provide rotational driving motion to the pump. A plurality of gears are driven by the rotational driving motion of the rod for providing a different rate of rotational motion to the agitating unit optimized to insure that the formation fines are fluidized for production to the surface of the earth rather than settling out within the well. A shaft connects the rotational motion of such gears to the agitating unit.

BRIEF DESCRIPTION OF THE DRAWING

The drawing illustrates a production well penetrating a viscous oil-bearing formation with the formation fluids being produced to the surface of the earth by means of the apparatus of the present invention.

DESCRIPTION OF THE PREFERRED EMBODIMENT

In accordance with the present invention there is provided apparatus within a production well for fluidizing formation fines, or sand, entrained in formation fluids from a subsurface oil-bearing formation, to insure that such formation fines are produced to the surface of the earth, through the well's pump rather than settling out in the well.

Referring now to the drawing, a viscous oil-bearing formation 10 is penetrated by a production well 11 employing well casing 12 and cement sheath 13. Production tubing 14 is disposed within the well and extends from the surface of the well or wellhead 15 to a suitable depth within the well below well casing perforations 16. Formation fluids from the viscous oil-bearing formation 10 enter the well through perforations 16 for production to the surface of the earth through the pump 17 affixed at the lower end of tubing 14.

Affixed to the pump 17 through gear box 18 and shaft 19 is an agitating unit 20. As the pump 17 operates to pump the formation fluids to the surface of the earth, the agitating unit 22 is rotatably operated to continuously stir up the formation fluid. Agitating unit 22 preferably comprises rotating blades, fins or other shaped devices that will fluidize the entrained formation fines, or sand, present in the formation fluid that would normally settle to the bottom of the production well 11. This prevents settling formation fines from inhibiting fluid flow and eventually causing shut-down of the pump 17 or blockage of the well casing perforations 16.

A typical pump 17 is driven by the rod 21 traversing the tubing 14 from the surface of the earth. In the case of the typical reciprocating pump, such as the sucker-rod pump, the rod 21 reciprocates upwardly and downwardly within tube I to drive the pump 17. In the case of the typical rotating rod pump, such as the progressive cavity pump, the rod 21 rotates within tube 14 to drive the pump 17. Downhole reciprocating and rotating rod pumps are well known in the art as illustrated in U.S. Pat. Nos. 3,338,306 to E. L. Cook; U.S. Pat. No. 3,305,825 to J. K. Godbey; U.S. Pat. No. 3,410,137 to V. R. Slover et al.; U.S. Pat. No. 3,682,244 to R. W. Bowman et al.; and U.S. Pat. No. 4,421,163 to G. E. Tuttle, the teachings of which are incorporated herein by reference, and are supplied by numerous manufacturers as listed in the Composite Catalog of Oil Field Equipment and Services, published by World Oil, P. 0. Box 2608, Houston, Tex. 77001.

Gear box 18 employs a plurality of gears for translating the motion of the pump 17 to an optimum rate of rotational movement of shaft 19 for driving agitating unit 20. In the case of a reciprocating pump 17, gear box 18 converts the reciprocal movement of the pump to an optimum rotational movement for fluidizing the formation fines. One such gear box is illustrated and described in detail in the aforementioned U.S. Pat. No. 3,305,825 to J. K. Godbey.

Having now described the present invention in conjunction with a preferred embodiment, it is to be understood that various modifications or changes may be made without departing from the spirit and scope of the invention as set forth in the appended claims.

We claim:

1. Apparatus for fluidizing formation fines entrained in formation fluid entering a production well through perforations in well casing penetrating a subsurface oil-bearing formation, comprising:

a) production tubing extending from the surface of the earth to a position below the lowermost of said perforations in said well casing, b) a downhole pump positioned at the lower end of said tubing for pumping formation fluid from said formation upwardly through said tubing to the surface of the earth, and c) an agitating unit positioned below said pump within said well, said agitating unit being rotated in the formation fluid within the production well below the lowermost of said perforations to fluidize formation fines entrained in said formation fluid so that they are produced upwardly through said pump and tubing to the surface of the earth.

2. The apparatus of claim 1 further comprising:

a) a rod extending from the surface of the earth through said tubing to said pump for providing driving motion to said pump, and b) means for translating the driving motion provided by said rod to a suitable rotational motion for driving said agitating unit.

3. The apparatus of claim 2 further comprising a shaft connecting said translating means to said agitating unit, said translating means rotating said shaft in response to the driving motion of said rod.

4. The apparatus of claim 1 further comprising:

a) a reciprocating rod extending from the surface of the earth through said tubing to said pump for providing reciprocating driving motion to said pump, and b) means positioned between said pump and said agitating unit for translating the reciprocating driving motion provided by said reciprocating rod to rotational motion for driving said agitating unit.

5. The apparatus of claim 4 wherein said translating means includes a plurality of gears driven by the reciprocating driving motion of said rod for providing an optimum rate of rotational driving motion to said agitating unit for fluidizing formation fines within said formation fluids so that said fines do not settle out of said formation fluids within said well.

6. The apparatus of claim 5 further comprising a shaft connecting the rotational motion provided by said gears to said agitating unit.

7. The apparatus of claim 1 further comprising :

a) a rotating rod extending from the surface of the earth through said tubing to said pump for providing rotational driving motion to said pump, and b) means positioned between said pump and said agitating unit for translating the rotational driving motion provided by said rotating rod to a different rate of rotational motion for driving said agitating unit.

8. The apparatus of claim 7 wherein said translating means includes a plurality of gears driven by the rotational driving motion of said rod for providing an optimum rate of rotational driving motion to said agitating unit for fluidizing the formation fines within said formation fluids so that said fines do not settle out of said formation fluids within said well.

9. The apparatus of claim 8 further comprising a shaft connecting the rotational motion provided by said gears to said agitating unit.

* * * * *